US005776013A

United States Patent [19]

Yokota et al.

[11] Patent Number: 5,776,013

[45] Date of Patent: Jul. 7, 1998

[54] SOLID GOLF BALL

[75] Inventors: Masatoshi Yokota; Seiichiro Endo; Keiji Moriyama, all of Shirakawa; Kuniyasu Horiuchi, Kobe, all of Japan

[73] Assignee: Sumitomo Rubber Industries, Ltd., Hyogo-ken, Japan

[21] Appl. No.: 713,654

[22] Filed: Sep. 13, 1996

[30] Foreign Application Priority Data

Sep. 14, 1995 [JP] Japan ..... 7-236655

[51] Int. Cl.[6] ..... A63B 37/12; A63B 37/14

[52] U.S. Cl. ..... 473/377; 473/378; 473/384

[58] Field of Search ..... 473/351, 377, 473/384, 378

[56] References Cited

U.S. PATENT DOCUMENTS 5,009,428 4/1991 Yamagishi et al. ..... 473/384

5,024,444 6/1991 Yamagishi et al. ..... 473/384

5,482,286 1/1996 Molitor et al. ..... 473/377 X 5,601,503 2/1997 Yamagishi et al. ..... 473/351

*Primary Examiner*—George J. Marlo

*Attorney, Agent, or Firm*—Birch, Stewart, Kolasch & Birch, LLP

[57] ABSTRACT

A solid golf ball having a solid core, a cover, and dimples formed on the surface of the cover, wherein the dimples satisfy the following equation:

(number of dimples)×(ratio of the area which is not occupied by dimples)÷(Shore D hardness of the cover) =1.4 to 1.9. The cover has a shore D hardness of 55–70 and a flexural modulus of 1,000 to 2,500 kgf/cm2. The core has a deformation amount of 2.4 to 3.5 mm when applying a load of from 10 to 130 kg. The dimples have diameters of 1.0 to 6.5 mm and the number of dimples is within the range of 330–440. The ratio of the area which is not occupied by dimples is within the range of 0.20 to 0.35.

7 Claims, 2 Drawing Sheets

SOLID GOLF BALL

FIELD OF THE INVENTION

The present invention relates to a solid golf ball. More particularly, it relates to a solid golf ball which has excellent controllability at approach shot.

BACKGROUND OF THE INVENTION

Hitherto, there have been mainly produced two types of golf balls. The one is a solid golf ball, such as a two piece golf ball, which comprises a core formed from vulcanized rubber material and a thermoplastic cover (e.g. ionomer cover) formed on the core. The other is a thread wound golf ball which comprises a liquid or solid center, a thread rubber winding layer formed on the center and a balata or ionomer cover formed thereon. The solid golf ball, when hit by either a driver or an iron club, flies with parabolic trajectory and obtains longer flight distance, thus showing excellent flight performance, in comparison with the thread wound golf ball. This feature is probably brought about by its inner structure, because the solid golf ball has such structural features that it does not obtain much spin, and creates parabolic trajectory which provides longer flight distance, but does not easily stop with an approach shot.

OBJECT OF THE INVENTION

A solid golf ball having good spin performance that one can deadly aim at a pin flag has been desired. In this case, the long flight distance which is inherent performance of the solid golf ball should be kept therein. The objective golf ball also has to have good shot feel.

SUMMARY OF THE INVENTION

The present invention is to provide a solid golf ball which has good shot feel and excellent spin performance which improves controllability at approach shot, i.e. easy stop on a green, and which, however, does not deteriorate the characteristics inherent to the solid golf ball, i.e. parabolic trajectory and long flight distance. The solid golf ball of the present invention comprises a solid core, a cover covering the core and dimples formed on the surface of the cover, wherein the dimples satisfy the following equation:

(number of dimples)×(ratio of the area which is not occupied by dimples)+(Shore D hardness of the cover)=1.4 to 1.9.

DETAILED DESCRIPTION OF THE INVENTION

First of all, some mechanism of the present invention will be explained, although it is not limited thereto. When considering the behavior of the golf ball at the time of approach shot, a head speed of the club at approach shot is lower than a full shot. If the same materials are used, the larger the practical contact area between the club and the golf ball, the more advantageous for controlling the golf ball flight. Accordingly, when considering only the controllability at approach shot, the larger the area which is not occupied by dimples and the lower the cover hardness, the larger the contact area between the golf ball and club face and the better. However, when the area which is not occupied by dimples is increased, the technical effects of dimples are small, which results in the decrease of flight distance. When the hardness of the cover is decreased, rebound characteristics are lowered and the flight distance is also lowered. When the number of dimples is increased, it is difficult to maintain the area which is not occupied by dimples. On the other hand, when the number of dimples is small, the trajectory at full shot is low and, therefore, the flight distance is lowered.

Figure 1:
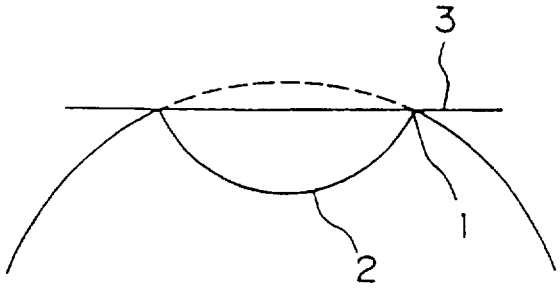
FIG. 1 is a schematic cross section illustrating one dimple of the solid golf ball of the present invention.
Figure 2:
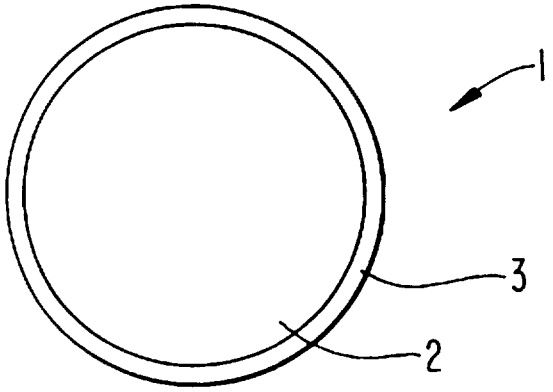
FIG. 2 is a schematic drawing which shows an embodiment of the golf ball (1) of the present invention having a core (2) and a cover (3).

Thus, the present inventors have evaluated various solid golf balls wherein the number of dimples, the area which is not occupied by dimples and the cover hardness vary. As a result, it has been found that a golf ball having excellent controllability at an approach shot while maintaining the flight performance and shot feel can be obtained, when the value of (number of dimples)×(ratio of the area which is not occupied by dimples)+(Shore D hardness of the cover) is within the range from 1.4 to 1.9, preferably 1.45 to 1.7. When the value is smaller than 1.4, controllability at the approach shot and shot feel are liable to be poor. On the other hand, when value is larger than 1.9, flight distance is lowered. In the present specification, the term "ratio of the area which is not occupied by dimples" represents a ratio of a discrepancy, obtained by subtracting the total area of circles formed by edges 1 of dimples 2 in FIG. 1 from a ball surface area calculated from a ball diameter, to the ball surface area. The Shore D hardness is a hardness measured according to ASTM D-2240.

In the present invention, the number of dimples is preferably from 330 to 440. When the number is smaller than 330, flight distance is lowered. On the other hand, when the number is larger than 440, controllability at approach shot is deteriorated and trajectory is low and, therefore, flight distance is liable to be lowered. The diameter of dimples is from 1.0 to 6.5 mm, preferably from 2.5 to 5.0 mm.

The ratio of of the area which is not occupied by dimples is preferably from 0.20 to 0.35, particularly from 0.23 to 0.30. When the ratio of is smaller than 0.20, controllability at an approach shot is deteriorated. On the other hand, when it is larger than 0.35, flight distance is lowered.

The Shore D hardness of the cover preferably is from 55 to 70, more preferably from 60 to 68. When the Shore D hardness is smaller than 55, rebound characteristics are lowered, which results in the decrease of flight distance. On the other hand, when it is larger than 70, controllability at approach shot and shot feel are deteriorated.

The flexural modulus of the cover is preferably from 1,000 to 2,500 kgf/cm$^2$, particularly from 1,300 to 2,400 kgf/cm$^2$. When the flexural modulus is smaller than 1,000 kgf/cm$^2$, flight distance is lowered. On the other hand, when it is larger than 2,500 kgf/cm$^2$, controllability at an approach shot is deteriorated.

In the present invention, the deformation amount when applying a load of from 10 kg to 130 kg to the core is preferably from 2.4 to 3.5 mm. When the deformation amount is smaller than 2.4 mm, the core is too hard and shot feel is deteriorated. On the other hand, when it is larger than 3.5 mm, rebound characteristics are deteriorated and flight distance is lowered.

The solid golf ball of the present invention can be either a two piece solid golf ball or a multi-piece solid golf ball of which core or cover is made plural layered. The core and cover can be made from any materials which have been used for golf balls, as long as the golf ball satisfies the features as claimed. Typical examples of the core and cover are hereinafter explained.

The core employed in the solid golf ball of the present invention can be obtained by vulcanizing a rubber composition in a mold. The rubber composition used for the core generally contains a base rubber, a crosslinking agent, a co-crosslinking agent, an inert filler and the like.

The base rubber can be natural rubber or synthetic rubber which has been used for solid golf balls, for example polybutadiene, polyisoprene rubber, styrene-butadiene rubber and EPDM. Preferred is polybutadiene rubber having cis-1,4 structure of at least 40%. The base rubber can be a mixture of the rubbers mentioned above.

The crosslinking agent which is used for initiating crosslinking reaction can be peroxides, such as dicumyl peroxide and di-t-butyl peroxide. Preferred is dicumyl peroxide. An amount of the peroxide is not limited but can be 0.3 to 5.0 parts by weight, preferably 0.5 to 3.0 parts by weight, based on 100 parts by weight of the base rubber.

The co-crosslinking agent is used for inserting crosslinked structure into rubber molecules and can be any one which has been used for solid golf balls. Typical examples of the co-crosslinking agents are metal salt of unsaturated fatty acid, such as one or divalent metal salt of α, β-unsaturated carboxylic acid having 3 to 8 carbon atoms. The metal includes sodium, potassium, magnesium, zinc and the like, and the α, β-unsaturated carboxylic acid includes acrylic acid and methacrylic acid. Preferred co-crosslinking agent is zinc acrylate because it imparts high rebound characteristics to the resulting golf ball. The co-crosslinking agent can be present in the rubber composition in an amount of 10 to 50 parts by weight, preferably 20 to 40 parts by weight based 100 parts by weight of the base rubber. Amounts of more than 50 parts by weight make the core too hard and lower shot feel and those of less than 10 parts by weight make the cover too soft.

The inert filler can be one used for golf balls and includes zinc oxide, barium sulfate, silica, calcium carbonate or zinc carbonate. Generally used is zinc oxide. An amount of the filler is not limited and can vary depending on specific gravity of core and weight regulation of golf ball, but may be within the range of 10 to 60 parts by weight based on 100 parts by weight of the base rubber.

The rubber composition can contain other components which have been used for cores of golf balls, such as antioxidant.

The above mentioned components are mixed to form a rubber composition which is then vulcanized at an elevated temperature under pressure in a mold to form a solid core. The vulcanization may be conducted at 130° to 180° C. for 10 to 60 minutes. The solid core of the present invention preferably has a diameter of 37 to 40 mm.

When the core is made two layers, an inner core is generally made from the above mentioned rubber composition and the outer core can be made from either the above mentioned rubber composition or another thermoplastic resin. The inner core preferably has a diameter of 27.0 to 38.0 mm, more preferably 28.0 to 36.0 mm and the outer layer has a thickness of 0.5 to 6.5 mm, preferably 1.5 to 5.5 mm, then its total being a diameter of 37 to 40 mm. The core can be made more than two layers.

The solid core obtained above is covered with a cover. The cover can be made from any material which has been used for the covers of golf balls, and typical examples of them are ionomer, polyamide, polyester, and a mixture thereof. Preferred is ionomer resin. Examples of the ionomer resin which is commercially available from Mitsui Du Pont Polychemical Co., Ltd. are ionomer resins such as Hi-milan 1557 (Zn), Hi-milan 1605 (Na), Hi-milan 1707 (Na), Hi-milan AM7318 (Na), Hi-milan 1705 (Zn), Hi-milan 1706 (Zn), Hi-milan 1652 (Zn), Hi-milan AM7315 (Zn), Hi-milan AM7317 (Zn), Hi-milan AM7311 (Mg), Hi-milan MK7320 (K); and terpolymer copolymer ionomer resins such as Hi-milan 1856 (Na), Hi-milan 1855 (Zn), Hi-milan AM7316 (Zn), etc. Examples of the ionomer resin which is commercially available from Du Pont Co., U.S.A. include ionomer resins such as Surlyn 8920 (Na), Surlyn 8940 (Na), Surlyn AD8512 (Na), Surlyn 9910 (Zn), Surlyn AD8511 (Zn), Surlyn 7930 (Li), Surlyn 7940 (Li); and terpolymer copolymer ionomer resins such as Surlyn AD8265 (Na), Surlyn AD8269 (Na), etc. Examples of the ionomer resin which is commercially available from Exxon Chemical Co. include lotek 7010 (Zn), 8000 (Na), etc. In addition, Na, Zn, K, Li, Mg, etc., which are described in parenthesis following the trade name of the above ionomer resin, mean neutralizing metal ion species thereof. The most preferred combination of the ionomer resins is a mixture of 15 to 40% by weight of an ionomer resin having a Shore D hardness of 65 to 68, 20to 40% by weight of an ionomer resin having a Shore D of 60 to 64 and 30 to 60% by weight of an ionomer resin having a Shore D hardness of 50 to 59; a total weight of the ionomer resins being 100% by weight.

The cover is mainly made from the thermoplastic resin as mentioned above, but may contain a small amount of additives, such as a colorant (e.g. titanium oxide), a UV absorber, a light stabilizer, a fluorescent agent and a fluorescent brightener, as long as the addition of the additives does not deteriorate the desired performance of the golf ball cover.

A method of covering the cover on the solid core is not specifically limited. For example, a method comprising molding a cover composition into a semi-spherical half-shell in advance, covering a core with two half-shells and then subjecting to a pressure molding at 130° to 170° C. for 1 to 15 minutes, or a method comprising injection molding the cover composition directly on the core to cover the core is used. When molding the cover, dimples may be optionally formed on the cover surface. After molding the cover, paint finishing and stamping may be optionally conducted. The cover may be made two or more layers, using different cover materials.

EXAMPLES

The following Examples and Comparative Examples further illustrate the present invention in detail but are not to be construed to limit the scope thereof.

Production of Core A

The formulation components shown in the formulation "a" of Table 1 were kneaded and then subjected to vulca nization molding to obtain a spherical core A having a diameter of 39.0 mm. As shown in Table 1, the vulcanization conditions are separately shown and the vulcanization was conducted in two stages. That is, the vulcanization was conducted at 142° C. for 20 minutes, followed by vulcanization at 165° C. for 8 minutes. A deformation amount when applying an initial load of 10 to a final load of 130 kg of the core A was 2.7 mm.

TABLE 1

| Kind | a |
|---|---|
| BR-11 (Note 1) | 100 |
| Zinc acrylate | 33 |
| Zinc oxide | 18 |
| Antioxidant (Note 2) | 0.5 |
| Dicumyl peroxide | 1.0 |
| Vulcanization condition | 142° C. × 20 minutes<br>165° C. × 8 minutes |
| Deformation amount of core (mm) | 2.7 |

Examples 1 to 4 and Comparative Examples 1 to 4

A cover layer was formed by injection-molding the components shown in Table 2 on the above core. The Shore D hardness and flexural modulus of the cover layer are shown in Table 2.

TABLE 2

| Kind | I | II | III | IV |
|---|---|---|---|---|
| Hi-milan #1706 (Note 3) | 5 | — | 30 | 50 |
| Hi-milan #1605 (Note 4) | 10 | 20 | — | 50 |
| Hi-milan #1855 (Note 5) | — | 70 | 30 | — |
| Hi-milan #1557 (Note 6) | — | 10 | 40 | — |
| Surlyn AD 8265 (Note 7) | 85 | — | — | — |
| Shore D hardness | 50 | 61 | 64 | 70 |
| Flexural modulus (kgf/cm$^2$) | 600 | 1500 | 2200 | 3300 |

(Note 1) Polybutadiene, manufactured by Japan Synthetic Rubber Co., Ltd.
(Note 2) Noklac NS-6, manufactured by Ohuchi Shinko Co., Ltd.
(Note 3) Ionomer resin neutralized with Zn, manufactured by Mitsui Polychemical Co., Ltd.
(Note 4) Ionomer resin neutralized with Na, manufactured by Mitsui Polychemical Co., Ltd.
(Note 5) Ionomer resin neutralized with Zn, manufactured by Mitsui Polychemical Co., Ltd.
(Note 6) Ionomer resin neutralized with Zn, manufactured by Mitsui Polychemical Co., Ltd.
(Note 7) Ionomer resin neutralized with Na, manufactured by Du Pont Co., U.S.A.

The kind of cores used and cover formulation are shown in Table 3. Dimples are formed simultaneously when molding the cover. The kind of dimples, number of dimples (N), ratio of the area which is not occupied by dimples (R), Shore D hardness (D) and value of N×R/D are shown in Table 3. The diameter and number of dimples produced practically are shown in Table 4.

The flight distance of the resulting golf ball was determined by hitting with a driver, and the controllability of approach was evaluated by conducting a test hitting by professional and top-amateur golfers. The results are shown in Table 3. The test method is as follows.

(Test method)

(1) Ratio occupied by dimples

It is a a ratio of the total area of circles formed by edges of dimples to a ball surface area calculated from a ball diameter.

(2) Flight distance

A golf ball produced by using the core and cover of the above formulation was practically hit with a driver at a head speed of 45 m/second, using a swing robot manufactured by True Temper Co.

(3) Approach controllability

The controllability at the time of approach (20 yard) was evaluated by 15 professional and top-amateur golfers according to the following criteria.

○: Not less than 10 out of 15 golfers felt that the golf ball is easily controlled.

Δ: About 9 to 4 out of 15 golfers felt that the golf ball is easily controlled.

X: Not more than 3 out of 15 golfers felt that the golf ball is easily controlled.

Example 5

In this Example, the example using a two-layer core is shown.

The formulation components shown Table 5 were kneaded and then subjected to vulcanization molding to obtain an inner core having a diameter of 34.2 mm. As shown in Table 5, the vulcanization was conducted at 150° C. for 30 minutes.

TABLE 5

| Kind | b |
|---|---|
| BR-11 (Note 1) | 100 |
| Zinc acrylate | 23 |
| Zinc oxide | 13 |
| Antioxidant (Note 2) | 0.5 |
| Dicumyl peroxide | 1.2 |
| Vulcanization condition | 150° C. × 30 minutes |
| Deformation amount of core (mm) | 2.8 |

A core B was produced by injection-molding the formulation components of the cover formulation IV on the resulting inner core. The thickness of the outer core was 1.9 mm. A golf ball was produced by covering the above formulation components shown of the cover formulation II on the resulting core B due to injection molding. Dimples are formed simultaneously when molding the cover. The kind of dimples, number of dimples (N), ratio of the area which is not occupied by dimples (R), Shore D hardness (D) and value of N×R/D are shown in Table 3 according to the same manner as that described in Examples 1 to 4. The diameter and number of dimples produced practically are shown in Table 4.

The flight distance of the resulting golf ball was determined by hitting with a driver, and the controllability of approach was evaluated by conducting a test hitting by professional and top-amateur golfers. The results are shown in Table 3 according to the same manner as that described in Example 1.

TABLE 3

| Item | Example No. 1 | 2 | 3 | 4 | 5 | Comparative Example No. 1 | 2 | 3 | 4 |
|---|---|---|---|---|---|---|---|---|---|
| Kind of core | A | A | A | A | B | A | A | A | A |
| Cover formulation | II | II | II | III | II | I | II | II | IV |
| Kind of dimples | B | C | D | C | C | C | A | E | C |
| Number of dimples (N) | 360 | 410 | 432 | 410 | 410 | 410 | 312 | 540 | 410 |
| Ratio of area which is not occupied by dimples (R) | 0.28 | 0.23 | 0.25 | 0.23 | 0.23 | 0.23 | 0.45 | 0.14 | 0.23 |
| Shore D hardness (D) | 61 | 61 | 61 | 64 | 61 | 50 | 61 | 61 | 70 |
| (N × R ÷ D) | 1.65 | 1.55 | 1.77 | 1.47 | 1.61 | 1.97 | 2.30 | 1.24 | 1.35 |
| Flight distance(yard) by a driver | 226 | 225 | 224.5 | 227 | 226 | 220 | 222 | 223 | 228 |
| Controllability at approach shot | ○ | ○ | ○ | ○ | ○ | ○ | ○ | X | X |

TABLE 4

| Kind | Diameter (mm) | Number | Total number |
|---|---|---|---|
| A | 3.8 | 192 | 312 |
| | 3.5 | 60 | |
| | 3.0 | 60 | |
| B | 4.0 | 186 | 360 |
| | 3.8 | 114 | |
| | 3.2 | 60 | |
| C | 4.2 | 50 | 410 |
| | 3.8 | 114 | |
| | 3.4 | 110 | |
| | 3.2 | 40 | |
| D | 4.0 | 132 | 432 |
| | 3.5 | 180 | |
| | 3.1 | 120 | |
| E | 4.0 | 60 | 540 |
| | 3.5 | 180 | |
| | 3.2 | 300 | |

As is apparent from the above results, the golf balls of Examples 1 to 5 wherein the value of (number of dimples) ×(ratio of the area which is not occupied by dimples)÷(Shore D hardness of the cover) is within the range from 1.4 to 1.9 attain almost the same flight distance as that of the golf balls of Comparative Examples 1 to 4 wherein the value is not within the above range, and are superior in controllability of approach.

What is claimed is:

1. A solid golf ball comprising a solid core, a cover covering said core and dimples formed on the surface of the cover, wherein said dimples satisfy the following equation:

(number of dimples)×(ratio of the area which is not occupied by dimples)÷(Shore D hardness of the cover) =1.4 to 1.9; and wherein the cover has a flexural modulus of 1,000 to 2,500 kgf/cm$^2$, and wherein the core has a deformation amount of 2.4 to 3.5 mm when applying a load of from 10 to 130 kg.

2. The solid golf ball according to claim 1, wherein the number of dimples is within the range of 330 to 440.

3. The solid golf ball according to claim 1, wherein the dimples have diameters of 1.0 to 6.5 mm.

4. The solid golf ball according to claim 1, wherein the ratio of the area which is not occupied by dimples is within the range of 0.20 to 0.35.

5. The solid golf ball according to claim 1, wherein the Shore D hardness of the cover is within the range of 55 to 70.

6. The solid golf ball according to claim 1, wherein the number of dimples is within the range of 330 to 440;

the ratio of the area which is not occupied by dimples is within the range of 0.20 to 0.35; and the Shore D hardness of the cover is within the range of 55 to 70.

7. The solid golf ball according to claim 6, wherein the dimples have diameters of 1.0 to 6.5 mm.

* * * * *